US008333851B2

(12) United States Patent
Suwabe

(10) Patent No.: US 8,333,851 B2
(45) Date of Patent: Dec. 18, 2012

(54) METHOD FOR PRODUCING TWO-PHASE STAINLESS STEEL PIPE

(75) Inventor: Hitoshi Suwabe, Osaka (JP)

(73) Assignee: Sumitomo Metal Industries, Ltd., Osaka-shi (JP)

( * ) Notice: Subject to any disclaimer, the term of this patent is extended or adjusted under 35 U.S.C. 154(b) by 110 days.

(21) Appl. No.: 12/667,667

(22) PCT Filed: Jul. 8, 2008

(86) PCT No.: PCT/JP2008/062333

§ 371 (c)(1),
(2), (4) Date: Jan. 4, 2010

(87) PCT Pub. No.: WO2009/014001

PCT Pub. Date: Jan. 29, 2009

(65) Prior Publication Data

US 2011/0024005 A1 Feb. 3, 2011

(30) Foreign Application Priority Data

Jul. 20, 2007 (JP) ..... 2007-189401
May 14, 2008 (JP) ..... 2008-126561

(51) Int. Cl.
*C21D 8/10* (2006.01)

(52) U.S. Cl. ..... 148/592; 148/593; 148/610; 148/909

(58) Field of Classification Search ..... 148/592, 148/593, 610, 909

See application file for complete search history.

(56) References Cited

U.S. PATENT DOCUMENTS 4,722,755 A * 2/1988 Maehara ..... 148/564
5,733,387 A 3/1998 Lee et al.
2006/0193743 A1* 8/2006 Semba et al. ..... 420/53
2007/0022796 A1* 2/2007 Hayashi ..... 72/97

FOREIGN PATENT DOCUMENTS

JP 60-89519 U 5/1985

(Continued)

OTHER PUBLICATIONS

English-hand translation of Japanese patent 360089519 A, Tsumura et al., May 20, 1985.*

(Continued)

*Primary Examiner* — Deborah Yee
(74) *Attorney, Agent, or Firm* — Marshall, Gerstein & Borun LLP

(57) ABSTRACT

A method for producing a two-phase stainless steel pipe, which comprises:

preparing a two-phase stainless steel material consisting of, by mass %, C: 0.03% or less, Si: 1% or less, Mn: 0.1 to 2%, Cr: 20 to 35%, Ni: 3 to 10%, Mo: 0 to 4%, W: 0.5 to 6%, Cu: 0 to 3% and N: more than 0.175 and up to 0.35%, and the balance being Fe and impurities;

forming a material pipe by subjecting to a hot working: and performing a cold drawing, where the cold drawing is characterized in being performed under the conditions that the working ratio Rd, in terms of the reduction of area, in the final cold drawing step is within a range from 5 to 35%, and the following formula (1) is satisfied:

$$Rd(\%) \geqq (MYS-55)/17.2-\{1.2\times Cr+3.0\times(Mo+0.5\times W)\} \quad (1).$$

3 Claims, 2 Drawing Sheets

FOREIGN PATENT DOCUMENTS

| | | | | |
|---|---|---|---|---|
| JP | 02-290920 | A | | 11/1990 |
| JP | 402274841 | A | * | 11/1990 |
| JP | 05-277611 | A | | 10/1993 |
| JP | 07-207337 | A | | 8/1995 |
| JP | 09-241746 | A | | 9/1997 |
| JP | 10-146681 | A | | 6/1998 |
| JP | 11-302801 | A | | 11/1999 |
| WO | WO 2004/111285 | A1 | * | 12/2004 |
| WO | WO 2005/068098 | A1 | * | 7/2005 |
| WO | WO-2009/014001 | A1 | | 1/2009 |

OTHER PUBLICATIONS

International Search Report in corresponding PCT/JP2008/062333 mailed Sep. 30, 2008.

Written Opinion in corresponding PCT/JP2008/062333 mailed Sep. 30, 2008 (Japanese only).

English translation of International Preliminary Report on Patentability in corresponding PCT/JP08/62333 dated Feb. 9, 2010.

English translation of Written Opinion in corresponding PCT/JP08/62333.

* cited by examiner

METHOD FOR PRODUCING TWO-PHASE STAINLESS STEEL PIPE

TECHNICAL FIELD

The present invention relates to a method for producing a two-phase stainless steel pipe or tube (hereinafter, collectively referred to as "pipe") that exhibits excellent corrosion resistance even in a carbon dioxide gas corrosive environment or in a stress corrosive environment, and that has a high strength. The two-phase stainless steel pipe produced according to the present invention can be used for, for example, oil wells or gas wells (hereinafter, collectively referred to as "oil wells").

BACKGROUND ART

In oil deep wells or in oil wells in severe corrosive environments involving corrosive substances such as humid carbon dioxide gas ($CO_2$), hydrogen sulfide ($H_2S$) or chloride ion ($Cl^-$), austenite-ferrite two-phase stainless steel pipes having a large content of Cr such as 22Cr steel or 25Cr steel are used as oil well pipes.

These austenite-ferrite two-phase stainless steels as having been subjected to the solution treatment usually applied in the production thereof can attain at most such a tensile strength (TS) that a tensile strength is of the grade of 80 kgf/mm$^2$ (785 MPa) and a yield strength (0.2% yield stress) is of the grade of 60 kgf/mm$^2$ (588 MPa). In consideration of this issue, JP2-290920A discloses a method for obtaining a high-strength two-phase stainless steel pipe, wherein a two-phase stainless steel pipe that contains 0.1 to 0.3% of N is subjected to a cold rolling with a reduction of area of 5 to 50%, and thereafter the pipe is heated at 100 to 350° C. for 30 minutes or more to yield the intended pipe. In this case, it is mentioned that a high-strength two-phase stainless steel pipe is obtained by combining the work hardening due to the cold rolling with the aging treatment.

However, in these years, oil wells have a remarkable tendency toward being deeper, and hence, for the purpose of the use in environments more severe than those hitherto experienced, it is required to produce two-phase stainless steel pipes which are high in strength, in particular, of the grade of 110 to 140 ksi (the lowest yield strength is 757.3 to 963.8 MPa) and additionally have various strength levels defined in the specifications. Thus, for that purpose, it is necessary to consider not only the content of N but the contents of the other composition elements, and also it is necessary to more strictly control the extent of the cold rolling. The production method disclosed in JP2-290920A offers a problem of the production efficiency deterioration or the cost increase due to the addition of the aging treatment step.

For the purpose of attaining a high corrosion resistance and a high strength, JP7-207337A discloses a method in which a Cu-containing two-phase stainless steel material is subjected to a cold rolling with a reduction of area of 35% or more, thereafter heated and quenched, and then subjected to a warm working. In this document, presented is a conventional example disclosing data showing that a Cu-containing two-phase stainless steel wire rod is subjected to a solid-solution heat treatment and thereafter subjected to a cold rolling with a reduction of area of 25 to 70%, and thus a high-strength wire rod having a tensile strength of 110 to 140 kgf/mm$^2$ has been obtained. However, in this case, disclosed is only the increase of the tensile strength due to the cold rolling, and the disclosed data is associated with a wire rod but not with a pipe, and hence it is not clear what is the level of the yield strength significant in the material design of the oil well pipes.

Further, JP5-277611A describes a high strength that can be attained by a low-working-ratio cold rolling based on forging. However, here is merely disclosed a method for improving the strength by successively forging with a cold rolling ratio of about 0.5 to 1.6% over the whole region, in the longitudinal direction, of a two-phase stainless steel stock that has been subjected to a solution treatment while the stock is being imparted with rotation.

DISCLOSURE OF THE INVENTION

As described above, any one of the above-described documents discloses the fact that the cold rolling enables to attain a high strength. However, in these documents no specific investigation has been made on the high strength attained by the cold rolling wherein the composition of the two-phase stainless steel pipe is taken into account, and no suggestion is offered with respect to the appropriate composition design or the cold rolling conditions for attaining the targeted strength, in particular, the targeted yield strength.

In view of these circumstances, an object of the present invention is to provide a method for producing a two-phase stainless steel pipe which has not only a corrosion resistance required for the oil well pipes used in deep wells or in severe corrosive environments but at the same time has a targeted strength.

For the purpose of solving the above-described problems, the present inventors produced two-phase stainless steel pipes by using two-phase stainless steel materials having various chemical compositions under the conditions that the extent of the final cold drawing was varied in different ways, and performed an experiment to determine the tensile strengths of these pipes. Consequently, the present inventors obtained the following findings (a) to (g).

(a) The two-phase stainless steel pipes used in deep oil wells or in oil wells in severe corrosive environments are required to have corrosion resistance. However, when the content of C is larger, the precipitation of the carbides tends to be excessive due to the thermal effects at the time of a heat treatment, welding or the like, and hence, from the viewpoints of the corrosion resistance and the workability of the steel, in particular, from the viewpoint of the corrosion resistance, it is necessary to reduce the content of C.

(b) When the content of C is reduced, the strength comes to be insufficient without applying any other operation; however, a material pipe produced by hot working of the two-phase stainless steel material or further by solid-solution heat treatment of the two-phase stainless steel material can be improved in strength by subsequently applying cold drawing. Here, it is to be noted that when the working ratio exceeds 35% in terms of the reduction of area, the high strength is maintained but the work hardening occurs, and hence the ductility or the toughness is deteriorated. On the other hand, when the working ratio is less than 5% in terms of the reduction of area, no intended high strength can be attained. Consequently, it is necessary to set the working ratio of the cold drawing at 5 to 35% in terms of the reduction of area.

(c) Also, it has been found that when the working ratio Rd at the time of cold drawing is in a range from 5 to 35% in terms of the reduction of area, the larger is the working ratio Rd of the final cold drawing in the two-phase stainless steel pipe, the higher is the yield strength YS obtained for the two-phase stainless steel pipe, and the relation between the working ratio Rd and the yield strength YS is represented as a linear relationship.

It has also been found that the strength of the two-phase stainless steel pipe is significantly affected by the content of Cr, and the higher is the content of Cr in the steel material, the higher-strength two-phase stainless steel pipe can be obtained. Further, it has also been found that the strength of the two-phase stainless steel pipe is also significantly affected by the content of Mo and the content of W, and the content of Mo or W enables to produce a high-strength two-phase stainless steel pipe.

FIG. 1 is a plot of the yield strength YS (MPa) values obtained in a tensile test against the working ratio Rd (%) values in terms of the reduction of area, for the two-phase stainless steel pipes having the various chemical compositions used in Example described below. FIG. 1 shows that there occurs a linear relationship between the working ratio Rd in terms of the reduction of area and the yield strength YS.

(d) Next, the present inventors have thought up that the yield strength of the two-phase stainless steel pipe is dependent on the working ratio Rd at the time of performing the cold drawing and the chemical composition of the two-phase stainless steel pipe, and accordingly it comes to be possible to establish an appropriate component design technique to be associated with the pipe working conditions, for the purpose of attaining the yield strength targeted for the two-phase stainless steel pipe. In other words, for the purpose of attaining the yield strength targeted for the two-phase stainless steel pipe, not the line regulation based on the chemical composition of the two-phase stainless steel pipe, but the fine regulation based on the working ratio Rd at the time of performing the cold drawing conies to be realizable. Also, it comes to be unnecessary to perform the melting of a large number of types of two-phase stainless steels prepared by varying the alloy composition according to the demanded strength level, and consequently, the overstock of the material billets can be suppressed.

As described above, when the appropriate component design technique associated with the pipe working conditions can be established, it is only required to perform the cold drawing, for the purpose of obtaining a two-phase stainless steel pipe having a targeted strength, under the cold drawing conditions targeted by taking account of the alloy composition of the stock, namely, with the targeted working ratio Rd or the higher working ratio than the targeted working ratio, without being required to vary the alloy composition of the stock on a case-by-case basis.

(e) On the basis of such an idea as described above, the present inventors have continuously made a diligent study on the correlations between the yield strength of the two-phase stainless steel pipe, the working ratio Rd at the time of performing the cold drawing and the chemical composition of the two-phase stainless steel pipe. Consequently, it has been found that when the working ratio Rd falls within a range from 5 to 35% in terms of the reduction of area at the time of performing the cold drawing, with respect to the two-phase stainless steel pipe, the yield strength YS (MPa) can be calculated on the basis of the working ratio Rd at the time of performing the cold drawing and the individual contents of Cr, Mo and W in the chemical composition of the two-phase stainless steel pipe on the basis of the following formula (2):

$$YS=17.2\times\{Rd+1.2\times Cr+3.0\times(Mo+0.5\times W)\}+55 \quad (2)$$

wherein YS and Rd signify the yield strength (MPa) and the working ratio (%) in terms of the reduction of area, respectively, and Cr, Mn and W signify the contents (mass %) of the respective elements.

FIG. 2 is a plot of the yield strength YS (MPa) values actually obtained by a tensile test against the values obtained by substituting, into the right hand side of the above-described formula (2), the chemical compositions and the working ratios Rd (%) in terms of the reduction of area, for the various two-phase stainless steel pipes used in Example described below, wherein the abscissa represents the Rd (%) and the ordinate represents the YS. FIG. 2 shows that as far as the two-phase stainless steel pipe is concerned, the yield strength of the two-phase stainless steel pipe can be obtained with a satisfactory accuracy, according to formula (2), from the chemical composition of the two-phase stainless steel pipe and the working ratio Rd (%) in terms of the reduction of area for the two-phase stainless steel pipe.

(f) Accordingly, for the purpose of obtaining a two-phase stainless steel pipe having a targeted strength, it is only required to develop, by the cold drawing, the yield strength fraction exclusive of the yield strength developed by the alloying components of the stock, namely, by the contents of Cr, Mo and W. Thus, for the purpose of attaining the targeted yield strength MYS (grade of 110 to 140 ksi (the lowest yield strength is 757.3 to 963.8 MPa)), after the selection of the chemical composition of the two-phase stainless steel pipe, it is only required to perform the final cold drawing with the working ratio Rd (%) obtained from the above-described formula (2) or the working ratio larger than this working ratio. Consequently, it is only required to perform the cold drawing under the conditions that the working ratio Rd, in terms of the reduction of area in the final cold drawing step, falls within a range from 5 to 35% and additionally the following formula (1) is satisfied:

$$Rd(\%)\geqq(MYS-55)/17.2-\{1.2\times Cr+3.0\times(Mo+0.5\times W)\} \quad (1)$$

wherein Rd and MYS signify the working ratio (%) in terms of the reduction of area and the targeted yield strength (MPa), respectively, and Cr, Mo and W signify the contents (mass %) of the individual elements, respectively.

(g) As described above, for the two-phase stainless steel pipe, without excessively adding the alloying elements, by selecting the cold rolling conditions, the targeted yield strength can be attained. Consequently, the reduction of the raw material cost can be achieved. Further, by selecting the cold rolling conditions in conformity with the alloy composition of the stock, the two-phase stainless steel pipe having the targeted strength can be obtained, and hence it comes to be unnecessary to perform the melting of a large number of types of two-phase stainless steels by varying the alloy composition depending on the strength level. Accordingly, the overstock of the material billets can be suppressed.

The present invention has been perfected on the basis of such new findings as described above, and the gist of the present invention is as described in what follows.

A method for producing a two-phase stainless steel pipe, which comprises, preparing a two-phase stainless steel material having a chemical composition that consists of, by mass %, C: 0.03% or less, Si: 1% or less, Mn: 0.1 to 2%, Cr: 20 to 35%, Ni: 3 to 10%, Mo: 0 to 4%, W: 0 to 6%, Cu: 0 to 3% and N: 0.15 to 0.35%, and the balance being Fe and impurities, forming a material pipe by subjecting to a hot working or further a solid-solution heat treatment, and performing a cold drawing, where the cold drawing is characterized in being performed under the conditions that the working ratio Rd, in terms of the reduction of area, in the final cold drawing step is within a range from 5 to 35%, and the following formula (1) is satisfied:

$$Rd(\%)\geqq(MYS-55)/17.2-\{1.2\times Cr+3.0\times(Mo+0.5\times W)\} \quad (1)$$

wherein Rd and MYS signify the working ratio (%) in terms of the reduction of area and the targeted yield strength (MPa), respectively, and Cr, Mo and W signify the contents (mass %) of the individual elements, respectively.

ADVANTAGE OF THE INVENTION

According to the present invention, a two-phase stainless steel pipe which has not only a corrosion resistance required for the oil well pipes used in deep wells or in severe corrosive environments but also has a targeted strength can be produced, without excessively adding alloying components, by selecting the cold rolling conditions.

BEST MODE FOR CARRYING OUT THE INVENTION

Next, description is made on the reasons for limiting the chemical composition of the two-phase stainless steel used in the method for producing a two-phase stainless steel pipe according to the present invention. Here, it is to be noted that "%" in the contents of individual elements represents "mass %."

C: 0.03% or less

C is an element that has an effect to improve the strength by stabilizing the austenite phase, and also has an effect to obtain a microstructure by precipitating carbides at the time of the temperature increase in the heat treatment. However, when the content of C exceeds 0.03%, the precipitation of the carbides comes to be excessive due to the thermal effects at the time of a heat treatment or welding, and thus the corrosion resistance and the workability of the steel are deteriorated. Consequently, the upper limit of the content of C is set at 0.03%. A preferable upper limit is 0.02%.

Si: 1% or less

Si is an element that is effective as a deoxidizer, and also has an effect to obtain a microstructure by precipitating an intermetallic compound at the time of temperature increase in the heat treatment, and hence Si can be contained if necessary. These effects are obtained for the content of Si of 0.05% or more. However, when the content of Si exceeds 1%, the precipitation of the intermetallic compound comes to be excessive due to the thermal effects at the time of a heat treatment or welding, and thus the corrosion resistance and the workability of the steel are deteriorated. Consequently, the content of Si is set at 1% or less. A preferable range of the content of Si is 0.7% or less.

Mn: 0.1 to 2%

Mn is an element that is effective as a deoxidizes similar to Si as described above, and also fixes S that is inevitably contained in the steel, as a sulfide to improve the hot workability. The effect of Mn is obtained with the content of Mn of 0.1% or more. However, when the content of Mn exceeds 2%, the hot workability is deteriorated, and also the corrosion resistance is adversely affected. Consequently, the content of Mn is set at 0.1 to 2%. A preferable range of the content of Mn is from 0.3 to 1.5%.

Cr: 20 to 35%

Cr is a fundamental component that is effective in maintaining the corrosion resistance and improving the strength. For the purpose of attaining these effects, it is necessary to set the content of Cr at 20% or more. However, when the content of Cr exceeds 35%, the σ-phase tends to be precipitated, and both of the corrosion resistance and the toughness are deteriorated. Consequently, the content of Cr is set at 20 to 35%. For the purpose of obtaining a higher strength, the content of Cr is preferably 23% or more. On the other hand, from the viewpoint of the toughness, the content of Cr is preferably 28% or less.

Ni: 3 to 10%

Ni is an element that is contained to stabilize the austenite phase and to obtain a two-phase microstructure. When the content of Ni is less than 3%, the ferritic phase predominates and no two-phase microstructure is obtained. On the other hand, when the content of Ni exceeds 10%, austenite predominates and no two-phase microstructure is obtained, and also the economy is impaired because Ni is an expensive element, and hence the content of Ni is set at 3 to 10%. It is preferable to set the upper limit of the content of Ni at 8%.

Mo: 0 to 4% (0% is Included.)

Mo is an element improves the pitting resistance and the crevice corrosion resistance, and also improves the strength through solid-solution strengthening, and hence Mo can be contained if necessary. When it is intended to obtain the effect of Mo, Mo is preferably contained in a content of 0.5% or more. On the other hand, when Mo is contained excessively, the σ-phase tends to be precipitated and the toughness is deteriorated. Consequently, the content of Mo is preferably set at 0.5 to 4%.

W: 0 to 6% (0% is Included.)

W is an element that, similar to Mo, improves the pitting resistance and the crevice corrosion resistance, and also improves the strength through the solid-solution strengthening, and hence W can be contained if necessary. When it is intended to obtain the effect of W, W is preferably contained in a content of 0.5% or more. On the other hand, when Mo is contained excessively, the σ-phase tends to be precipitated and the toughness is deteriorated. Consequently, the content of W is preferably set at 0.5 to 6%.

It is to be noted that it is not necessary to contain any of Mo and W; however, either or both of Mo: 0.5 to 4% and W: 0.5 to 6% can be contained.

Cu: 0 to 3% (0% is Included.)

Cu is an element that improves the corrosion resistance and the grain boundary corrosion resistance, and Cu can be contained if necessary. When it is intended to obtain the effect of Cu, Cu is preferably contained in a content of 0.1% or more, further preferably, 0.3% or more. However, when the content of Cu exceeds 3%, the effect of Cu is saturated, and adversely the hot workability and the toughness are deteriorated. Consequently, when Cu is contained, the content of Cu is set preferably at 0.1 to 3%, more preferably, at 0.3 to 2%.

N: 0.15 to 0.35%

N is an element that enhances the stability of austenite, and at the same time enhances the pitting resistance and the crevice corrosion resistance of the two-phase stainless steel. N, similar to C, has an effect to stabilize the austenite phase and to improve the strength, and hence N is an important element for the present invention that attains a high strength. When the content of N is less than 0.15%, no sufficient effect of N is obtained. On the other hand, when the content of N exceeds 0.35%, the toughness and the hot workability are deteriorated, and consequently, the content of N is set at 0.15 to 0.35%. For the purpose of obtaining a higher strength, the content of N preferably exceeds 0.17%. The further preferable content of N is 0.2 to 0.3%.

Moreover, on the basis of the below-described reasons, P, S and O contained as the impurities are preferably limited in such a way that P: 0.04% or less, S: 0.03% or less and O: 0.010% or less.

P: 0.04% or less

P is contained as an impurity. When the content of P exceeds 0.04%, the hot workability is deteriorated, and the corrosion resistance and the toughness are also deteriorated. Consequently, the upper limit of the content of P is preferably set at 0.04%.

S: 0.03% or less

S is contained as an impurity, similar to P as described above. When the content of S exceeds 0.03%, the hot workability is remarkably deteriorated, and also, sulfides function as the starting points of the occurrence of pitting to impair the pitting resistance. Consequently, the upper limit of the content of S is preferably set at 0.03%.

O: 0.010% or less

In the present invention, the hot workability tends to be deteriorated because N is contained in such a larger amount as 0.15 to 0.35%. Hence, the content of O is preferably set at 0.010% or less.

The two-phase stainless steel according to the present invention may further contain one or more of Ca, Mg and the rare earth elements (REMs), in addition to the above-described elements. The reasons for permission of these elements and the permitted contents of these elements are as follows.

One or more of Ca: 0.01% or less, M 0.01% or less and rare earth element(s): 0.2% or less.

These components can be contained if necessary. When contained, any of these components fixes S that disturbs the hot workability, as a sulfide, and thus has an effect to improve the hot workability. However, when the content of any of Ca and Mg exceeds 0.01%, and the content of the REM(s) exceeds 0.2%, coarse oxides are produced, and the deterioration of the hot workability is caused. Accordingly, when these elements are contained, the upper limits of these elements are 0.01% for Ca and Mg, and 0.2% for the REM(s), respectively. It is to be noted that for the purpose of certainly developing the improving effect of the hot workability, it is preferable to contain Ca and Mg in a content of 0.0005% or more and the REM(s) in a content of 0.001% or more. Herein, the REMs mean the 17 elements which are the 15 lanthanoid elements and Y and Sc.

The two-phase stainless steel pipe of the present invention contains the above-described essential elements and additionally the above-described optional elements, the balance being Fe and impurities, and can be produced by the production equipment and the production method used for the usual commercial production. For example, for the melting of the two-phase stainless steel, there can be used an electric furnace, an Ar—$O_2$ mixed gas bottom blowing decarburization furnace (AOD furnace), a vacuum decarburization furnace (VOD furnace) or the like. The molten steel obtained by melting may be cast into ingots, or may be cast into rod-like billets by a continuous casting method. By using these billets, with an extrusion pipe production method such as the Ugine-Sejournet method or with hot working such as the Mannesmann pipe production method, a material pipe for cold rolling of the two-phase stainless steel can be produced. The material pipe subjected to the hot working is formed into a product pipe having an intended strength by cold drawing.

Also, the present invention defines the working ratio at the time of the final cold rolling. The material pipe for cold rolling is subjected to the hot working, and, if necessary, may be further subjected to a solid-solution heat treatment, and thereafter the descaling for removing the scales on the pipe surface may be performed, and thus a two-phase stainless steel pipe having an intended strength may be produced by one run of cold rolling. Alternatively, one or more runs of intermediate cold rolling (intermediate drawing) and a solid-solution heat treatment may be performed, and the final cold drawing may be performed after descaling. By performing an intermediate cold drawing, the working ratio in the final cold drawing is easily controlled, and, as compared to the case where the cold drawing is applied in the state of having been subjected to hot working, a pipe having a higher-accuracy pipe dimension can be obtained by the final cold drawing.

EXAMPLE 1

First, the two-phase stainless steels having the chemical compositions shown in Table 1 were melted with an electric furnace, and were regulated with respect to the components so as to have approximately the intended chemical compositions, and thereafter, the melting was performed by a method in which by using an AOD furnace, a decarburization treatment and a desulfurization treatment were conducted. Each of the obtained molten steels was cast into an ingot having a weight of 1500 kg and a diameter of 500 mm. Then, the ingot was cut to a length of 1000 mm to yield a billet for use in the extrusion pipe production. Next, by using this billet, a material pipe for cold drawing was formed by the hot extrusion pipe production method based on the Ugine-Sejournet method.

[Table 1] Below

TABLE 1

| Test | Chemical compositions (mass %, the balance being Fe and impurities) | | | | | | | | | | |
|---|---|---|---|---|---|---|---|---|---|---|---|
| No. | C | Si | Mn | P | S | Cr | Ni | Mo | W | Cu | N |
| 1 | 0.014 | 0.31 | 0.49 | 0.025 | 0.0005 | 25.15 | 6.69 | 3.08 | 2.12 | 0.48 | 0.285 |
| 2 | 0.016 | 0.33 | 0.47 | 0.019 | 0.0005 | 24.72 | 6.55 | 3.08 | 2.13 | 0.46 | 0.275 |
| 3 | 0.016 | 0.33 | 0.47 | 0.019 | 0.0005 | 24.72 | 6.55 | 3.08 | 2.13 | 0.46 | 0.275 |
| 4 | 0.016 | 0.30 | 0.47 | 0.024 | 0.0006 | 25.09 | 6.72 | 3.07 | 2.10 | 0.49 | 0.296 |
| 5 | 0.020 | 0.45 | 0.73 | 0.026 | 0.0003 | 25.28 | 6.25 | 3.04 | 0.18 | 0.42 | 0.230 |
| 6 | 0.020 | 0.40 | 0.65 | 0.030 | 0.0003 | 25.00 | 6.40 | 3.10 | 0.15 | 0.50 | 0.230 |
| 7 | 0.020 | 0.40 | 0.65 | 0.030 | 0.0003 | 25.00 | 6.40 | 3.08 | 0.15 | 0.50 | 0.230 |
| 8 | 0.020 | 0.40 | 0.65 | 0.030 | 0.0003 | 25.11 | 6.40 | 3.12 | 0.15 | 0.50 | 0.230 |
| 9 | 0.024 | 0.47 | 1.13 | 0.023 | 0.0003 | 22.14 | 5.09 | 3.11 | 0.12 | 0.19 | 0.177 |
| 10 | 0.023 | 0.40 | 1.20 | 0.028 | 0.0005 | 22.50 | 5.10 | 3.20 | 0.12 | 0.20 | 0.175 |
| 11 | 0.023 | 0.40 | 1.20 | 0.028 | 0.0005 | 22.46 | 5.10 | 3.18 | 0.12 | 0.20 | 0.175 |
| 12 | 0.023 | 0.40 | 1.20 | 0.028 | 0.0005 | 22.50 | 5.10 | 3.20 | 0.12 | 0.20 | 0.175 |

The obtained material pipe for cold rolling was subjected to an intermediate drawing, and thereafter subjected to a solution heat treatment under the conditions that water-cooling was performed after being maintained at 1050 to 1120° C. for 2 minutes or more. Thereafter, the working ratio Rd (%) in terms of the reduction of area was varied so as to have different values as shown in Table 2, and further the final cold drawing based on the drawing method using a plug and a dice was performed, and thus a two-phase stainless steel pipe was obtained. It is to be noted that before the cold drawing was performed, a shotblast was applied to the pipe, and thus the scales on the surface were removed. The dimensions (the outer diameter in mm×the wall thickness in mm) of each of the pipes before and after the final cold rolling are shown in Table 2.

[Table 2] Below

TABLE 2

| Test No. | Dimensions before final cold drawing (Outer dimension mm × inner dimension mm) | Dimensions after final cold drawing (Outer dimension mm × inner dimension mm) | Rd (%) | Right hand side of Formura(2) (MPa) | Observed value YS (MPa) | Observed value TS (MPa) |
|---|---|---|---|---|---|---|
| 1 | 198.5 × 26.15 | 188.4 × 25.4 | 8.0 | 925.3 | 929.4 | 1039.5 |
| 2 | 188.0 × 10.9 | 178.5 × 10.4 | 9.0 | 933.9 | 929.4 | 1039.5 |
| 3 | 95.0 × 7.1 | 89.3 × 6.4 | 15.0 | 1037.1 | 1053.3 | 1104.9 |
| 4 | 79.0 × 8.25 | 73.4 × 7.0 | 20.4 | 1136.3 | 1133.2 | 1163.5 |
| 5 | 205.0 × 11.7 | 194.6 × 10.9 | 11.5 | 936.1 | 936.3 | 970.7 |
| 6 | 157.0 × 21.1 | 145.6 × 19.8 | 13.0 | 958.4 | 970.7 | 1050.6 |
| 7 | 95.0 × 14.1 | 83.5 × 12.3 | 23.0 | 1129.4 | 1122.2 | 1184.1 |
| 8 | 168.0 × 12.6 | 158.0 × 21.4 | 11.0 | 927.3 | 943.2 | 1018.9 |
| 9 | 187.0 × 10.7 | 178.5 × 10.3 | 8.0 | 813.1 | 812.4 | 881.2 |
| 10 | 109.0 × 15.4 | 100.9 × 14.4 | 14.0 | 928.4 | 945.9 | 1029.2 |
| 11 | 101.0 × 7.6 | 89.3 × 6.6 | 23.0 | 1081.4 | 1074.0 | 1115.3 |
| 12 | 141.0 × 18.5 | 129.4 × 16.8 | 16.5 | 971.4 | 981.0 | 1039.5 |

Thereafter, from the obtained two-phase stainless steel pipes, arc-shaped tensile test specimens in the pipe axis direction were sampled, and subjected to a tensile test. The observed values as the results of the test, namely, the yield strength YS (MPa) (0.2% yield stress) values and the tensile strength TS (MPa) values in the tensile test are shown in Table 2 together with the numerical values based on the right hand side of formula (2).

Industrial Applicability

The results are as described above, and hence, according to the present invention, a two-phase stainless steel pipe that has not only a corrosion resistance that is required for the oil well pipes used in deep wells or in severe corrosive environments, but also has a targeted strength can be produced, without excessively adding alloying components, by selecting cold rolling conditions.

Figure 1:
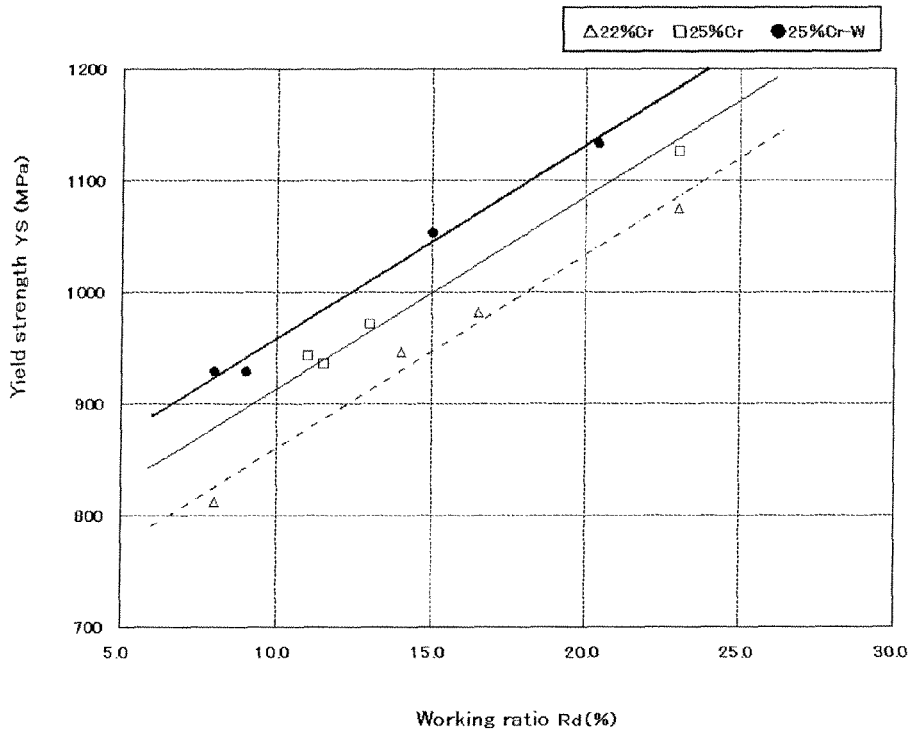
FIG. 1 is a plot of the yield strength YS (MPa) values obtained in a tensile test against the working ratio Rd (%) values in terms of the reduction of area, for two-phase stainless steel pipes.
Figure 2:
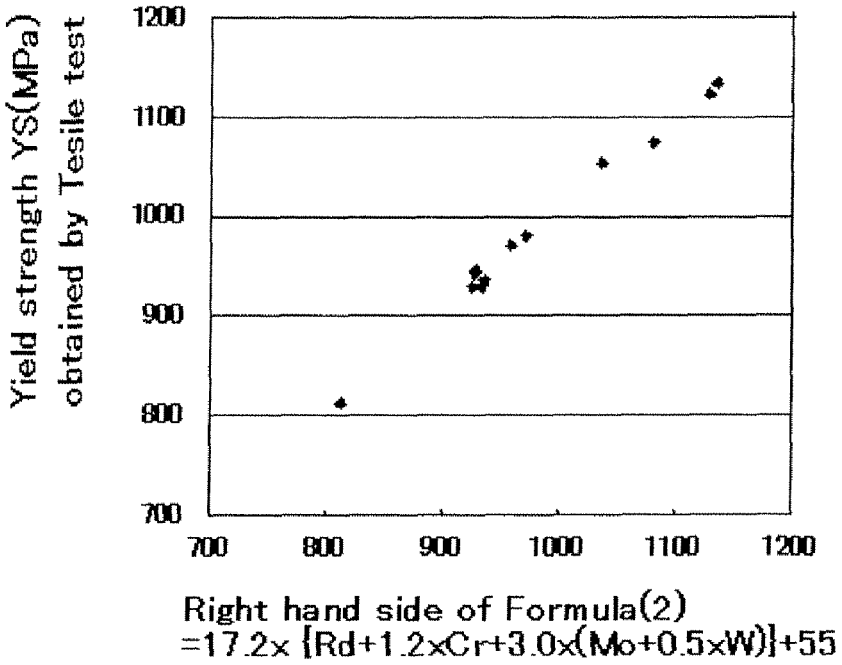
FIG. 2 is a plot of the yield strength YS (MPa) values obtained by a tensile test against the values obtained by substituting, into the right hand side of the above-described formula (2), the chemical compositions and the working ratios Rd (%) in terms of the reduction of area, for the two-phase stainless steel pipes, wherein the abscissa represents the Rd (%) and the ordinate represents the YS.

The invention claimed is:

1. A method for producing a two-phase stainless steel pipe, which comprises, preparing a two-phase stainless steel material having a chemical composition that consists of, by mass %, C: 0.014 to 0.03%, Si: 1% or less, Mn: 0.1 to 2%, Cr: 20 to 35%, Ni: 3 to 10%, Mo: 0 to 4%, W: 2.10 to 6%, Cu: 0 to 3% and N: more than 0.17% and up to 0.35%, and the balance being Fe and impurities;

forming a material pipe by subjecting to a hot working and performing a cold drawing, where the cold drawing is characterized in being performed under the conditions that the working ratio Rd, in terms of the reduction of area, in the final cold drawing step is within a range from 5 to 35%, and the following formula (1) is satisfied:

$$Rd(\%) \geqq (MYS-55)/17.2-\{1.2\times Cr+3.0\times(Mo+0.5\times W)\} \quad (1)$$

wherein Rd and MYS signify the working ratio (%) in terms of the reduction of area and the targeted yield strength (MPa), respectively, and Cr, Mo and W signify the contents (mass %) of the individual elements, respectively.

2. A method for producing a two-phase stainless steel pipe according to claim 1 wherein the hot working is based on the Ugine-Sejournet extrusion pipe production method.

3. A method for producing a two-phase stainless steel pipe according to claim 1 wherein the hot working is based on the Mannesmann pipe production method.

* * * * *